United States Patent [19]

Grosse

[11] 4,103,855

[45] Aug. 1, 1978

[54] SUPPORT SYSTEMS FOR ARTICLES OF FURNITURE

[76] Inventor: Maurice Grosse, 25 Woodberry Crescent, London N10., England

[21] Appl. No.: 701,529

[22] Filed: Jul. 1, 1976

[51] Int. Cl.[2] ..... A47G 29/02

[52] U.S. Cl. ..... 248/246; 108/108; 211/90

[58] Field of Search ..... 248/243, 245, 246, 248; 108/108; 211/90, 190, 193, 207, 135, 153, 176, 102

[56] References Cited

U.S. PATENT DOCUMENTS

| | | | |
|---|---|---|---|
| 3,200,775 | 8/1965 | Peters | 108/108 |
| 3,664,627 | 5/1972 | Sykes et al. | 248/246 |

FOREIGN PATENT DOCUMENTS

| | | | |
|---|---|---|---|
| 1,388,531 | 4/1964 | France | 248/246 |
| 422,259 | 4/1967 | Switzerland | 248/246 |

*Primary Examiner*—J. Franklin Foss

*Attorney, Agent, or Firm*—Larson, Taylor and Hinds

[57] ABSTRACT

A support system for articles of furniture, such as shelves, which system comprises uprights each of which has a recess throughout substantially all of its length, the recess opening onto the front of the upright and the opening being flanked at at least one edge by a re-entrant lip, the system also comprising single-limbed brackets with limb of each bracket having an upper rim constructed for hooking co-operation with one of the re-entrant lips and a lower region whose back is arranged to abut against the forwardly facing rear surface of the recess in the corresponding upright, each bracket also comprising a support which projects forwardly from the upright to which that bracket is operatively connected at any chosen level in the use of the system.

6 Claims, 2 Drawing Figures

SUPPORT SYSTEMS FOR ARTICLES OF FURNITURE

Figure 1:
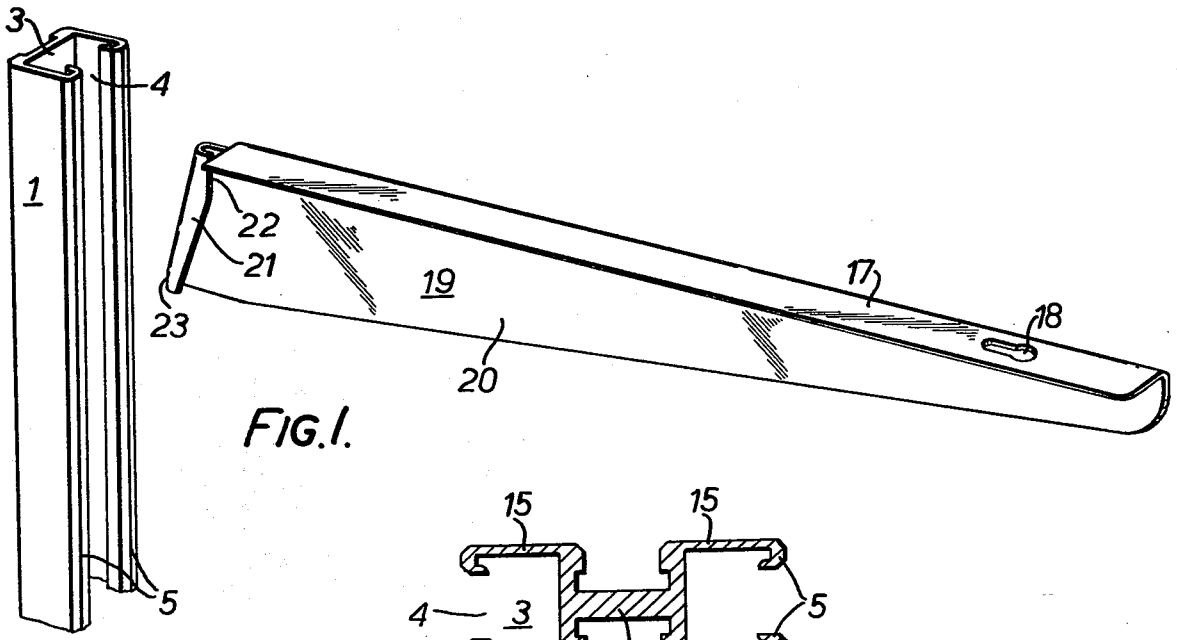

This invention relates to support systems for articles of furniture.

Many furniture support systems are known and the majority of modern systems comprise a plurality of uprights or standards and a plurality of brackets that can be releasably connected to the uprights or standards at selected horizontal levels in such a way that, when so connected, surfaces of the brackets are contained in horizontal planes, or planes that are inclined to the horizontal by a few degrees, to support metallic, wooden or other shelves, cabinets and like articles of furniture from beneath. The brackets usually comprise simple means to enable the shelves, cabinets or other articles of furniture to be releasably fastened thereto and many of the modern systems enable each bracket to be disposed at any chosen one of an infinite number of horizontal levels relative to the upright or standard with which it co-operates, the form of frictional connection between each bracket and its co-operating upright or standard being such that, when it is loaded from above by a shelf or other article of furniture and also by any items placed on or in that article of furniture, the bracket does not tend to be displaced downwardly along the upright or standard. Some systems are also known in which each bracket can only occupy any chosen one of a plurality of regularly spaced apart locations that are at corresponding horizontal levels along the uprights or standards. With such a construction, each bracket is positively retained against being displaced downwardly along its co-operating upright or standard when it is loaded from above but, of course, arrangements of this kind do not have the degree of flexibility that is inherent in systems in which the brackets can be placed at an infinite number of different levels on the uprights or standards.

It is an object of the present invention to provide a support system for articles of furniture in which both the uprights or standards and the brackets are of a very simple and inexpensive construction which nevertheless give a strong and reliable support to shelving, cabinets and other articles of furniture when they are in use.

According to the invention, there is provided a support system for articles of furniture which system comprises at least one upright shaped to define along substantially the whole of its length a recess which includes a rear wall having a forwardly facing substantially planar and rigid surface throughout substantially the whole of its width and side walls which open onto the front of the upright, the opening of the recess being flanked at at least one edge by a re-entrant lip turned back by substantially 180°, and which system also comprises at least one bracket comprising a single limb constructed and arranged for entry in said recess, the bracket limb comprising a turned back upright engaging portion which is turned back by substantially 180° and which includes an upper rim that hooks behind said re-entrant lip and has a free edge which, in use, extends substantially vertically and engages the concave surface of the lip, and a flat formed on a lower region of said turned back upright engaging portion that abuts against the said forwardly facing substantially planar and rigid surface of the rear wall of the recess at points defining a finite transversely and vertically extending area, said bracket also comprising a support portion which projects forwardly from the upright when the bracket is operatively connected to the upright.

Figure 2:
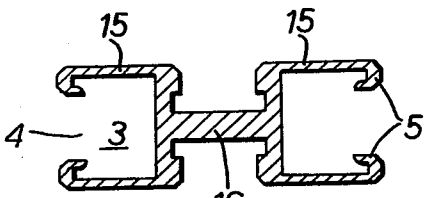

For a better understanding of the invention, and to show how the same may be carried into effect, reference will now be made, by way of example, to the accompanying drawings, in which:

FIG. 1 is a perspective view of an upright or standard and a single-limbed bracket of a support system for articles of furniture in accordance with the invention in a disconnected condition, and FIG. 2 is a perpendicular cross-section through an alternative form of upright or standard that may form a part of a system in accordance with the invention.

Referring to FIG. 1 of the drawings, that Figure illustrates an upright or standard that is generally indicated by the reference 1 and a bracket that is generally indicated by the reference 19. The upright or standard 1 is formed throughout substantially the whole of its vertical length (it may be closed at at least one of its ends, if desired) with a recess 3 which opens onto the front of the upright or standard 1 to form a mouth 4. The two opposite edges of the opening of the recess that is afforded by the mouth 4 are flanked by corresponding re-entrant lips 5 whose shapes can be seen best in FIG. 2 of the drawings to which further reference will be made below. It will be seen from the drawings that the extreme free edges of the lips 5 are turned back by substantially 180° so as to be directed rearwardly into the recess 3 towards the back of the latter, said back preferably being substantially planar as shown, across the width of the recess. The upright or standard 1 is preferably formed from a rigid material such as metal, such as aluminium or an alumninium alloy, the formation conveniently, but not essentially, being effected by extrusion. In this connection, it will be noted that the internal shape of the recess 3 is particularly simple being merely rectangular in cross-section except at the open front of that cross-section where the mouth 4 is formed with the re-entrant lips 5.

The bracket 19 that is illustrated in FIG. 1 of the drawings is preferably formed from the same metallic material as is the upright or standard 1 but, in the case of the bracket 19, it is stamped or punched from sheet metal and is subsequently bent to shape. The bracket 19 is of basically triangular configuration and comprises a flat upper support 17 which will project forwardly from the upright or standard 1 when the bracket 19 is operatively connected to that upright or standard. In the particular embodiment which is being described, the support 17 will be substantially horizontally disposed under the circumstances which have just been mentioned. The support 17 is formed, towards the end thereof that will be furthest from the upright or standard 1 when the bracket 19 is in use, with a keyhole-shaped slot 18 that may be employed in releasably connecting the bottom of an overlying shelf, cabinet or other article of furniture to said support.

The bracket 19 comprises a single limb 20 that will be vertically disposed in the use of the bracket and an uppermost edge region of which is perpendicularly bent over to form the support 17. One end of the limb 20 is constructed and arranged for entry in the recess 3 of the upright or standard 1 and is formed with an end portion 21 which portion 21 is, in fact, bent over through 180° about an axis that is inclined by a few degrees to the vertical relative to the remainder of the limb 20. An upper rim 22 of the portion 21 has a substantially vertically disposed and forwardly directed free edge and is arranged for hooking co-operation with one of the re-entrant lips 5 of the upright or standard 1 so that said free edge engages the concave surface of that lip whilst the back of a lower region 23 of the portion 21 is cut, filed, machined or otherwise formed as a flat, i.e. a portion having points lying in a vertical plane which define a finite transversely and vertically extending area, that is intended to abut strictly vertically against the forwardly facing surface of the rear of the recess 3 when the upright or standard 1 is also strictly vertically disposed. The substantially vertical flat that is comprised by the lower region 23 of the limb portion 21 is, in fact, formed by removing material from the rearwardly facing convex surface of the 180° bend which interconnects the planar part of the end portion 21 and the planar limb 20, proper.

The bracket 19 that is illustrated in FIG. 1 of the drawings is connected to the upright or standard 1 merely by entering the end of the limb 20 that comprises the portion 21 into the recess 3. The upper rim 22 is then brought into hooking engagement with the appropriate re-entrant lip 5 which, in the example illustrated in FIG. 1 of the drawings, will be the left-hand lip 5 as seen in that Figure. Establishing the hooking engagement will involve turning the bracket 19 downwardly through a few degrees about an imaginary substantially horizontal axis that perpendicularly interconnects the two limbs of the upright or standard 1 so that the flat at the back of the lower region 23 of the end portion 21 will come into abutting engagement against the forwardly facing surface of the rear of the recess 3 at substantially the same time as the leading substantially vertical edge of the upper rim 22 comes into hooking engagement with the co-operating and similarly disposed re-entrant lip 5. The frictional co-operation between the rim 22 and the lip 5 of the upright or standard 1 is such that the metal of the bracket 19 and/or of the upright or standard 1 would bend or break due to overloading before a weight carried by the support 17 of said bracket would cause that bracket to slide downwardly along the co-operating limb of the upright or standard 1. Nevertheless, the bracket 19 can readily be moved upwardly or downwardly along the upright or standard 1 to a new horizontal level merely by gripping its outer end, tilting it upwardly through a few degrees about an imaginary horizontal axis relative to the upright or standard 1 and simultaneously pushing it towards the interior of the recess 3 to break the hooking engagement between the upper rim 22 and the co-operating re-entrant lip 5. Once this has been done, the bracket 19 is free of positive engagement with the upright or standard 1 and can be raised or lowered to the desired new level without difficulty.

The bracket 19 that is illustrated in FIG. 1 of the drawings is only one example of a number of different single-limbed brackets that may be constructed for use in a system in accordance with the invention. Firstly, it will be realised that a bracket of symmetrically opposite construction to the bracket 19 that is illustrated in FIG. 1 could readily be employed. The upper rim 22 of the end portion 21 of such a bracket would, of course, co-operate with the right-hand, rather than the left-hand, re-entrant lip 5 as illustrated in FIG. 1 of the drawings and it will be noted that two such left-hand and right-hand brackets can be used alongside one another at the same, or substantially the same, horizontal level, it still being possible to install and/or remove one of those brackets without having to interfere with the other neighbouring bracket in any way. In the illustrated bracket 19, its support 17 is formed at the top thereof but this is by no means essential and both left-hand and right-hand brackets may be formed at the bottom with supports that are equivalent to the illustrated support 17. It is not necessary to illustrate a bracket of this kind since the end portion thereof will be identical to the described and illustrated end portion 21 whilst its single limb will be effectively inverted as compared with the illustrated limb 20 and will thus have a substantially horizontal lower edge formed with a perpendicularly bent-over support that corresponds to the support 17 and an outwardly and downwardly inclined upper edge. However, to ensure that the back of the lower region 23 of the end portion 21 of such a bracket will always reliably abut against the forwardly facing surface of the back of the recess 3 of the co-operating upright or standard 1, a small substantially semi-circular recess is preferably formed in the inner end of the support that corresponds to the support 17, said recess being in register with the co-operating re-entrant lip 5 in the use of the bracket so that said end of the support shall always remain clear of contact with said lip 5. It will be realised that, if contact between the support and the lip 5 were to be made at this point, it would interfere with the frictional engagement of the back of the lower region 23 of the end portion 21 with the upright or standard 1.

The illustrated bracket 19 has an overall front to rear length of substantially 31.5 centimeters but, clearly, this is not essential and both longer and shorter brackets may be provided for co-operation with articles of furniture of different kinds. Purely as one example, shorter brackets with overall lengths of substantially 8.5 centimeters may be provided, such brackets being furnished with supports in both left-handed and right-handed form with those supports at either their tops or their bottoms. Brackets of this kind may additionally, or as an alternative, be formed with means for the connection thereto of projections at the sides of articles of furniture, such as cabinets.

The illustrated upright or standard 1 may be fastened in its position of use in any convenient manner. For example, the back of its recess 3 may be formed at more or less regular intervals with countersunk holes for co-operation with the heads of wood screws or machine screws. The heads of such screws are, of course, readily accessible to a screwdriver through the mouth 4 of the recess 3. FIG. 2 of the drawings shows a modification in which a double upright or standard 15 is provided. The backs or bases of the two uprights or standards of this double unit 15 are integrally interconnected by a strong vertical rib 16 which may, if desired, be formed at regular intervals along its length with vertical slots (not shown) to save material and weight and to assist in fastening. It will be appreciated that the double upright or standard 15 of FIG. 2 of the drawings can be formed by the extrusion of aluminium, aluminium alloy or the like just as easily as can the single upright or standard 1. Other multiple uprights or standards can, of course, also be provided and, in this connection, it is noted that a single upright or standard having only one of the re-entrant lips 5 would co-operate entirely satisfactorily with a single-limbed bracket such as the bracket 17 of FIG. 1. An upright or standard of this kind could have the configuration of either the right-hand, or the left-hand, half of the illustrated upright or standard 1, its recess then being afforded by the substantially right-angled space that is enclosed between the limb having the re-entrant lip 5 and a limb corresponding to the rear of the illustrated upright or standard 1. Multiple units could comprise three, four, or even more such uprights or standards appropriately interconnected by ribs. It is noted here that, although an integral construction will usually be most convenient, it is not essential that the rear of the upright or standard should be integral with its one or two lip-carrying limbs.

It will be appreciated that, when a support equivalent to one of the supports 17 is formed at the bottom of the bracket 19, said support is usable to sustain one end of a shelf from beneath whilst the upright limb of the bracket to which said support is connected will extend upwardly above that shelf at one end thereof. The limb in question will thus function as a "book-end" for a row of books placed on the shelf or as a divider between items such as box files and the like. Although not forming part of the present invention, it is noted that the uprights or standards 1 or 15 can be used in carrying quite heavy cabinets and like articles of furniture by employing suspension clips each of which comprises a hooking rim constructed for hooking engagement with one of the re-entrant lips 5 and a machine screw which can be tightened so as very firmly to retain the clip at a chosen level along the lip 5 concerned. The clips incorporate upwardly facing recesses which will co-operate with appropriately positioned openings in cabinets and like articles of furniture so that the system which has been described can include such clips and is then capable of supporting shelves, light cabinets, heavy cabinets, book and magazine racks, storage racks, radio, phonograph and television set plinths, work boxes, desk units and a variety of other articles of home and/or office furniture, such articles being formed wholly or principally from wood and/or wholly or principally from metal and/or synthetic plastics materials.

I claim:

1. A support system for articles of furniture which system comprises at least one upright shaped to define along substantially the whole of its length a recess which includes a rear wall having a forwardly facing substantially planar and rigid surface throughout substantially the whole of its width and side walls which open onto the front of the upright, the opening of the recess being flanked at at least one edge by a re-entrant lip turned by substantially 180°, and which system also comprises at least one bracket comprising a single limb constructed and arranged for entry in said recess, the bracket limb comprising a turned back upright engaging portion which is turned back by substantially 180° and which includes an upper rim that hooks behind said re-entrant lip and has a free edge which, in use, extends substantially vertically and engages the concave surface of the lip, and a flat formed on a lower region of said turned back upright engaging portion that abuts against the said forwardly facing substantially planar and rigid surface of the rear wall of the recess at points defining a finite transversely and vertically extending area, said bracket also comprising a support portion which projects forwardly from the upright when the bracket is operatively connected to the upright.

2. A support system according to claim 1, wherein the upright defines said recess so as to be rectangular in cross-section except at the front thereof where the opening of the recess is flanked by two said re-entrant lips.

3. A support system according to claim 1, wherein the flat at the back of the lower region of said limb is formed as a vertical cut through the otherwise convex curved surface of the substantially 180° turned back back of the limb.

4. A support according to claim 1, wherein the support of said bracket which projects forwardly from the upright when the bracket is operatively connected to the upright comprises means for releasably fastening an article of furniture thereto.

5. A support system according to claim 1, wherein the upright is in the form of a multiple unit comprising at least two uprights whose backs are interconnected by at least one vertical rib.

6. A support system according to claim 1, said flat being formed as a transversely extending flat rib.

* * * * *